US005238306A

United States Patent [19]

Heintz et al.

[11] Patent Number: 5,238,306

[45] Date of Patent: Aug. 24, 1993

[54] METHOD OF PRODUCING A SEALING SYSTEM FOR A RECLOSABLE WEBBED-WALL PACKAGE, AND SYSTEM MADE

[75] Inventors: David A. Heintz, Richmond, Va.; Steven H. Simonsen; Wayne M. Wegner, both of Appleton, Wis.

[73] Assignee: Reynolds Consumer Products, Inc., Appleton, Wis.

[21] Appl. No.: 354,252

[22] Filed: May 19, 1989

[51] Int. Cl.[5] ..... B65D 33/34; B65D 33/02

[52] U.S. Cl. ..... 383/61; 383/63; 383/210; 493/211; 493/930; 493/962

[58] Field of Search ..... 383/61, 63, 210, 211; 493/211, 213, 214, 930, 962; 156/66; 264/177.1

[56] References Cited

U.S. PATENT DOCUMENTS

| | | | |
|---|---|---|---|
| 2,848,031 | 8/1958 | Svec et al. . | |
| 2,978,769 | 4/1961 | Harrah . | |
| 3,054,434 | 9/1962 | Ausnit et al. . | |
| 3,172,443 | 3/1965 | Ausnit . | |
| 3,181,583 | 5/1965 | Lingenfelter . | |
| 3,226,787 | 1/1966 | Ausnit . | |
| 3,228,168 | 1/1966 | Grindrod et al. . | |
| 3,339,606 | 9/1967 | Kugler . | |
| 3,371,696 | 3/1968 | Ausnit . | |
| 3,417,675 | 12/1968 | Ausnit . | |
| 3,425,469 | 2/1969 | Ausnit . | |
| 3,454,210 | 7/1969 | Spiegel et al. . | |
| 3,460,337 | 8/1969 | Feild . | |
| 3,473,589 | 10/1969 | Gotz . | |
| 3,532,571 | 10/1970 | Ausnit . | |
| 3,608,439 | 9/1971 | Ausnit . | |
| 3,608,707 | 9/1971 | Miller . | |
| 3,619,395 | 11/1971 | Skendzic . | |
| 3,647,485 | 3/1972 | Seiferth et al. . | |
| 3,740,237 | 6/1973 | Grindrod et al. . | |
| 3,744,211 | 7/1973 | Titchenal et al. . | |
| 3,780,781 | 12/1973 | Uramoto . | |
| 3,792,181 | 2/1974 | Mahaffy et al. . | |
| 3,817,821 | 6/1974 | Gallini . | |
| 3,879,492 | 4/1975 | Bontinick . | |
| 3,945,403 | 3/1976 | Noguchi | 383/63 X |
| 3,948,705 | 4/1976 | Ausnit . | |
| 3,953,661 | 4/1976 | Gulley . | |
| 4,003,972 | 1/1977 | Herz . | |
| 4,118,166 | 10/1978 | Bartrum . | |
| 4,189,519 | 2/1980 | Ticknor . | |
| 4,189,809 | 2/1980 | Sotos . | |
| 4,212,337 | 7/1980 | Kamp . | |
| 4,240,241 | 12/1980 | Sanborn, Jr. . | |
| 4,246,288 | 1/1981 | Sanborn, Jr. . | |
| 4,252,238 | 2/1981 | Spiegelberg et al. . | |
| 4,260,116 | 4/1981 | Collin . | |
| 4,273,815 | 6/1981 | Gifford et al. . | |
| 4,285,376 | 8/1981 | Ausnit . | |
| 4,325,653 | 11/1981 | Ausnit . | |

(List continued on next page.)

FOREIGN PATENT DOCUMENTS 0239319 9/1987 European Pat. Off. .

(List continued on next page.)

OTHER PUBLICATIONS

*Easy Open Peelable Seal Packaging with Duraflex Polybutylene Resins*, Shell Chemical Company.

(List continued on next page.)

*Primary Examiner*—Allan N. Shoap
*Assistant Examiner*—Jes F. Pascua
*Attorney, Agent, or Firm*—Willian Brinks Olds Hofer Gilson & Lione

[57] ABSTRACT

A closure system for a film wall package includes profile strips having a reclosable seal of the interlocking type, flange elements and, adjacent the reclosable seal, an adhered strip of peelable material. The peelable material and the profile strip may be co-extruded. With packaging film attached to the profile strips, typically to the flange elements, the resulting product may be used in a horizontal form, fill and seal operation, at which time the reclosable elements are mated and a peel seal is formed. The peel seal may be disposed on either side of the reclosable seal with respect to the interior of the package. The benefits of both peel seals and reclosable seals may be obtained by using optimum materials for those elements while, at the same time, allowing the use of a different material for the walls of the package.

22 Claims, 1 Drawing Sheet

U.S. PATENT DOCUMENTS

| | | | |
|---|---|---|---|
| 4,346,196 | 8/1982 | Hoh et al. . | |
| 4,355,494 | 10/1982 | Tilman . | |
| 4,379,806 | 4/1983 | Korpman . | |
| 4,405,667 | 9/1983 | Christensen et al. . | |
| 4,419,159 | 12/1983 | Herrington . | |
| 4,428,788 | 1/1984 | Kamp . | |
| 4,437,293 | 3/1984 | Sanborn, Jr. . | |
| 4,469,754 | 9/1984 | Hoh et al. . | |
| 4,479,244 | 10/1984 | Ausnit | 383/63 |
| 4,497,678 | 2/1985 | Nussbaum . | |
| 4,498,939 | 2/1985 | Johnson . | |
| 4,514,625 | 5/1985 | Ausnit . | |
| 4,515,647 | 5/1985 | Behr . | |
| 4,518,087 | 5/1985 | Goglio . | |
| 4,519,095 | 5/1985 | Clayton . | |
| 4,528,224 | 7/1985 | Ausnit . | |
| 4,539,263 | 9/1985 | Hoh . | |
| 4,540,537 | 9/1985 | Kamp . | |
| 4,555,282 | 11/1985 | Yano . | |
| 4,561,109 | 12/1985 | Herrington . | |
| 4,589,145 | 5/1986 | Van Erden et al. . | |
| 4,617,683 | 10/1986 | Christoff . | |
| 4,619,021 | 10/1986 | Johnson | 383/63 X |
| 4,655,862 | 4/1987 | Christoff et al. . | |
| 4,656,075 | 4/1987 | Mudge . | |
| 4,663,915 | 5/1987 | Van Erden et al. . | |
| 4,673,601 | 6/1987 | Lamping et al. . | |
| 4,682,366 | 7/1987 | Ausnit et al. . | |
| 4,691,372 | 9/1987 | Van Erden . | |
| 4,691,373 | 9/1987 | Ausnit | 383/63 |
| 4,698,118 | 10/1987 | Takahashi . | |
| 4,736,451 | 4/1988 | Ausnit . | |
| 4,744,674 | 5/1988 | Nocek . | |
| 4,755,247 | 7/1988 | Mudge . | |
| 4,756,629 | 7/1988 | Tilman et al. . | |
| 4,759,642 | 7/1988 | Van Erden et al. | 383/61 X |
| 4,782,951 | 11/1988 | Griesbach et al. . | |
| 4,786,190 | 11/1988 | Van Erden et al. . | |
| 4,823,961 | 4/1989 | Griesbach et al. | 383/61 X |
| 4,832,505 | 5/1989 | Ausnit et al. | 383/5 |
| 4,835,835 | 6/1989 | Gould . | |
| 4,896,775 | 1/1990 | Boeckmann et al. | 383/64 X |
| 4,923,701 | 5/1990 | Van Erden . | |
| 4,925,316 | 5/1990 | Van Erden et al. | 383/65 X |
| 4,925,318 | 5/1990 | Sorensen . | |
| 4,947,525 | 8/1990 | Van Erden . | |
| 4,966,470 | 10/1990 | Thompson et al. | 383/61 |
| 4,969,967 | 11/1990 | Sorensen et al. . | |

FOREIGN PATENT DOCUMENTS

| | | | |
|---|---|---|---|
| 0302144A3 | 2/1989 | European Pat. Off. . | |
| 2546481 | 11/1984 | France . | |
| 2613326 | 10/1988 | France | 383/63 |
| 54-143388 | 11/1979 | Japan . | |
| 55-126059 | 9/1980 | Japan . | |
| 57-105248 | 12/1983 | Japan . | |
| 1546433 | 5/1979 | United Kingdom . | |
| 2080412A | 2/1982 | United Kingdom . | |
| 2129770 | 5/1984 | United Kingdom | 383/63 |

OTHER PUBLICATIONS

Charles C. Hwo, *Easy Open Seals for Flexible Packaging and Lidding*, monograph and slide presentation, Shell Development Company, 1986.

Charles C. Hwo, *Polybutylene Blends as Easy Open Seal Coats for Flexible Packaging and Lidding*, Shell Development Company, 1987.

Charles C. Hwo, Larry K. Watkins and Malcolm P. Schard, "Packaging Design with Polybutylene Resins for Easy-Open-Peelable Seal Systems," *TAPPI Proceeding, 1988 Polymers, Laminations and Coatings Conference, Book 1*, p. 41 et seq.

Charles C. Hwo, "Polybutylene Blends as Easy Open Seal Coats for Flexible Packaging and Lidding," *TAPPI Proceedings, 1987 Polymers, Laminations and Coatings Conference*, Book 2, p. 613.

*DURAFLEX Polybutylene Specialty Resins Properties Guide*, Shell Chemical Company.

METHOD OF PRODUCING A SEALING SYSTEM FOR A RECLOSABLE WEBBED-WALL PACKAGE, AND SYSTEM MADE

BACKGROUND OF THE INVENTION

The current invention relates to methods of forming a sealing system for a reclosable package, and the package made. In particular, it relates to a system for a package having walls of film or the like, typically formed from one or two webs sealed at the edges, the package having a reclosable seal and a peel seal.

There has been recent interest in expanding the use of reclosable seals of the interlocking type, which typically are of the rib and groove type often informally called a zipper.

Seals of this type are disclosed in U.S. Pat. No. 2,978,769 of Harrah, U.S. Pat. No. 3,198,228 of Naito and U.S. Pat. No. 4,212,337 of Kamp.

Zipper seals may be manufactured in advance as elements that may be called "profile strips" and later attached to webbing, as shown in U.S. Pat. No. 3,948,705 of Ausnit. In the alternative, the seals may be co-extruded together with one or more film members that will form the walls of the package.

It is presently preferred for such profile strips to be manufactured of polyethylene. Not only is polyethylene less expensive than many other materials typically used in this technology, but it does not take a strong set. That is, when manufactured in advance the profile strips may be wound on a spool or the like and, when unwound later, do not strongly tend to resume the wound shape. This provides a significant advantage.

Also in the past, packages have been provided having additional seals to complement interlocking seals. Such packages are shown in U.S. Pat. No. 3,181,583 of Lingenfelter (rupturable tear line) and U.S. Pat. No. 4,246,288 of Sanborn, Jr. (hermetic seal).

Second seals specifically made of peelable material are shown in U.S. Pat. No. 4,782,951 of Griesbach et al. (used in connection with interlock closure strips 14) and U.S. Pat. No. 4,786,190 of Van Erden et al. (used in combination with reclosable pressure sensitive adhesive 29).

Especially in the case where peelable material is used to provide a seal, it is desirable to minimize the amount of such material used. It is costly in comparison to other seal materials used in this technology.

As known in the art, the so-called "peelable material" referenced above is used to make a non-reclosable seal called a "peel seal." Certain materials, typically of resinous composition, are known to react in such a manner that they can be used in combination either with a dissimilar material or with additional material of the same composition to produce such seals. Therefore, whether or not a seal is peelable depends upon the materials used. This specification uses the term "peelable material" to describe a single element of such material, but it will be understood by those skilled in the art that the term refers to such a material when used together with additional material of the same or different composition in order to produce a peel seal.

SUMMARY OF THE INVENTION

The current invention includes a method of producing a sealing system for a package, the method comprising the steps of forming first and second profile strips, each strip comprising a longitudinally-extending reclosable seal element of the interlocking type and adhering a strip of peelable material to at least one of the profile strips substantially parallel to and proximate the reclosable seal means. It is presently preferred that the peelable sealing system be produced by co-extruding the profile strip and the adhered peelable material.

A package having such a sealing system will enjoy the benefits of two separate seals: a reclosable seal offering the benefits of a standard profile seal and a non-reclosable peel seal offering the benefits of such seals.

Typically, the peelable material would be heat-sealed together at a time later than the time of manufacture of the sealing system, and most typically following the introduction of contents to a packaging web during a horizontal form, fill and seal operation. However, variations are possible Also typically, the two interlocking seals would be joined together shortly after manufacture and the resulting zipper rolled on a spool. At a later time, the two profile strips will be joined to one or two webs of film to form the walls of the package. (In known manner, whether one or two webs of film are used to form the walls of the package will depend upon whether a single web is folded over to form two walls.) However, if desired the profile strips and the container walls may be co-extruded together.

The current invention also pertains to the product made by a process such as those described above.

The profile strips may include flange elements used for subsequent joining to film layers that form the walls of the package. The flanges disclosed herein take the form of flange elements having thickened sections to form a heat barrier as disclosed and claimed in U.S. patent application Ser. No. 07/342,257 of Wirth, Wegner, Tomic, Buchko and Natterer, the disclosure of which is hereby incorporated by reference.

An advantage of using separate strips for the reclosable seal means is that one is not as limited by the composition of the materials used, and may sometimes use a less expensive material for the seal while attaining superior performance. For example, a preferred material for use in packing meat is an iononomer resin from du Pont marketed under the trademark SURLYN®. Yet, as explained above, it is presently preferred to manufacture a profile strip from polyethylene. The use of reclosable profile strips with SURLYN® is described in commonly-owned U.S. patent application Ser. No. 07/353,993 of Wegner, Tomic, Kolosso and Simonsen filed May 19, 1989, the disclosure of which is hereby incorporated by reference.

An advantage of using a reclosable profile strip is that it provides a durable reclosable seal that is more desirable for certain applications than other reclosable seals such as adhesive seals. A further advantage of the current invention is that in certain cases, package size may be reduced.

DETAILED DESCRIPTION OF THE PREFERRED EMBODIMENTS

Figure 1:
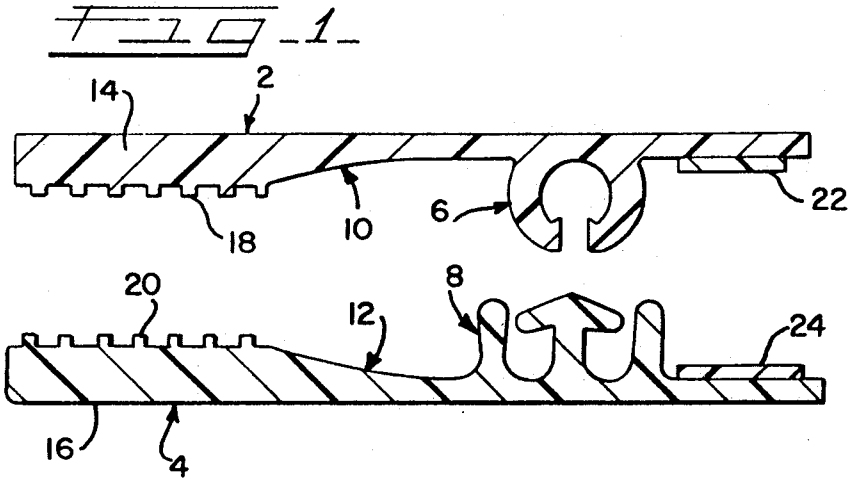
FIG. 1 is a cross-sectional elevation of a first embodiment of profile strips according to the current invention, shortly after manufacture and before being joined together.

Shown in FIG. 1 are cross-sections of profile strips 2, 4 respectively having formed thereon interlocking reclosable seal means elements 6, 8. To the left of the elements 6, 8 in FIG. 1 are flange elements 10, 12 having distal ends in the form of thickened sections 14, 16. Preferably, the sections 14, 16 have formed thereon ridges 18, 20. The functions of the elements 14–20 is such that profile strips 2 and/or 4 may be heat sealed to bag wall material while the strips are joined together, without also heat sealing the two strips together. In this way, the thickened flange elements facilitate bonding to packaging material, as described in greater detail in the above-mentioned U.S. patent application 07/342,257.

Figure 3:
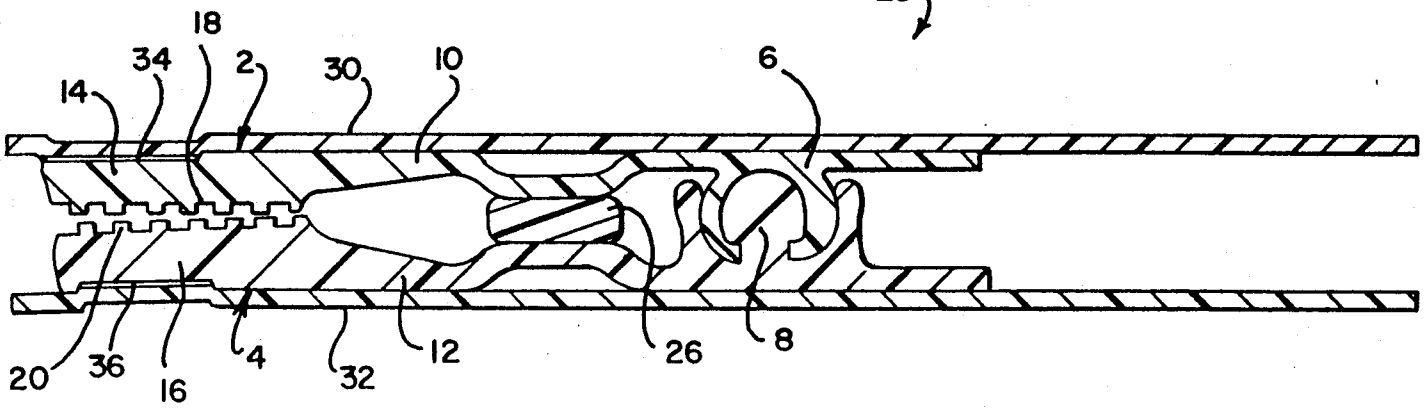
FIG. 3 is a fragmentary cross-section of a package according to the current invention and showing a seal made from the second embodiment described above, before being opened for the first time.

The interlocking seal means 6, 8 extend longitudinally of the profile strips 2, 4. First and second strips 22, 24 of peelable material also extend longitudinally of the profile strips, substantially parallel to and proximate the reclosable seal means 6, 8. It will be understood that, at some point before a package embodying the sealing system is completed, the strips of peelable material 22, 24 will be heat-sealed together to form a peel seal 26 as shown in FIG. 3.

It is preferred that the adherence of the strips 22, 24 to the profile strips 2, 4 be attained by co-extrusion of the profile strip with adhered peelable material. The material of the profile strips 2, 4 is preferably polyethylene but may be another known material for such use. Typically, the peel seal material may be made using SURLYN®. In particular, the peelable material may be made from one hundred percent virgin SURLYN® ionomer resin with additives blended-in or a product presently commercially known as SURLYN® 8414-1. In the alternative, a non-SURLYN® peelable material may be made by blending certain grades of polybutylene with ethylene vinyl acetate copolymer, or polyethylene, or both. An example of such polybutylenes are various grades marketed as DURAFLEX® by Shell Chemical Company, Polybutylene Business Center, Houston, Tex.

The use of other peelable materials may be possible. Those set forth above are presently thought to be the most common. Nevertheless, the current invention is applicable to any extrudable peel seal material.

The embodiment of FIG. 1 is a sealing system in which the peel seal that is to be formed will be disposed on that side of the reclosable seal that is toward the interior of the package.

Figure 2:
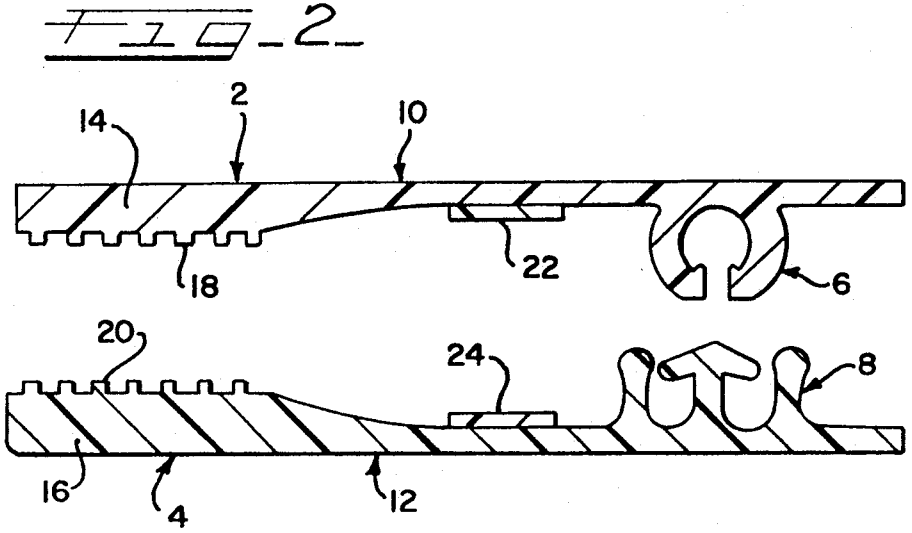
FIG. 2 is a cross-section of a second embodiment of profile strips according to the current invention, before being joined together.

FIG. 2 shows a second embodiment according to the current invention in which the peel seal will be disposed on the exterior side of the reclosable seal. For purposes of the current invention, the two embodiments are otherwise thought to be substantially equivalent. However, users may have reasons for preferring one embodiment of the other. For example, the embodiment of FIG. 2 may be more compact, and the embodiment of FIG. 1 may prove easier to seal in connection with a step of applying top and bottom film layers 30, 32. According to either embodiment, there will result a single peel seal 26. The type of equipment used in forming the final package also may dictate the embodiment preferred.

As an alternative to the embodiments shown in FIGS. 1 and 2, one may provide that only one of the two profile strips has a strip of peelable material The current invention applies to two generic types of peel seals, both of which are known in the art. According to one type, the peel seal 26 will fail during opening at some point across its thickness. According to the second type, the peel seal 26 may remain intact when the package is opened, one of the two profile strips simply being peeled away from the peel seal. For purposes of the present invention, this distinction is not important.

As stated above, the profile strips according to the current invention may be co-extruded together with the walls of the package. In the alternative, as shown in FIG. 3, a package 28 may comprise a top film layer 30 and bottom film layer 32 joined by heat seals 34 and 36 to the profile strips 2, 4.

During manufacture, dual profile strips may be formed by making tandem pairs of profile strips, as disclosed in the said U.S. patent application Ser. No. 07/342,257. Also within the scope of the current invention is the option of expanding the strips of peelable material 22, 24 so that they cover substantial portions of the profile strip surfaces on which they are disposed. Indeed, both profile strips of a mating pair may be formed of materials that produce a peelable seal between them, thereby eliminating the separate, discrete elements 22, 24.

While this invention is susceptible of embodiment in many different forms, there is shown in the drawings and described herein in detail preferred embodiments of the invention with the understanding that the present disclosure is to be considered as an exemplification of the principles of the invention and is not intended to limit the broad aspects of the invention to the embodiments illustrated.

We claim:

1. A sealing system for a package, the sealing system comprising:

first and second profile strips, each strip comprising longitudinally-extending reclosable seal means and a flange element, a portion of at least one of the flange elements being thickened to facilitate heat sealing said flanges to walls of said package without also heat sealing the strips together in the area of the thickened flange;

a seal of peelable material, heat sealable to form a peelable seal, disposed between the profile strips and taking the form of a strip extending longitudinally of and proximate the reclosable seal means;

and wherein the reclosable seal means comprises a material different than the peelable material.

2. The invention of claim 1 wherein:

the invention further comprises webbing adhered to the respective flange elements of said sealing system, the webbing comprising at least one wall of a package.

3. A method of producing a sealing system for a package comprising the steps of:

forming first and second profile strips, each profile strip comprising longitudinally-extending reclosable seal means of the interlocking type and a flange element, a portion of at least one of the flange elements being thickened to facilitate heat sealing said flanges to walls of said package without also heat sealing the strips together in the area of the thickened flange;

forming on at least one of the profile strips a peelable material different than the material of which the reclosable seal means is comprised and capable of being heat sealed to form a peelable seal with the other profile strip; and carrying out said peelable material forming step so that the peelable material is disposed in elongate strip fashion substantially parallel to and proximate the reclosable seal means on the at least one profile strip.

4. The method of claim 3, further comprising the step of adhering webbing to the respective flange elements, thereby forming opposite sides of a package.

5. A profile strip including reclosable seal means, having a strip of peelable material, heat sealable to form a peelable seal, co-extruded on the profile strip substantially parallel to and proximate the reclosable seal means, wherein the reclosable seal means comprise a material different than the peelable material, and a flange, a portion of the flange being thickened to facilitate bonding said flange to a package wall without also heat sealing the strip to a mating profile strip in the area of the thickened flange.

6. The invention of claim 5, the resealable profile strips being of the interlocking type.

7. A method of making a reclosable closure for a package comprising the steps of:

forming, by extruding, a first member of a package closure adapted to be joined to a wall of a package, said first member having formed thereon a first portion of a reclosable zipper and comprising a flange;

forming, by extruding, a second member of the package closure adapted to be joined to a wall of a package and having formed thereon a second portion of the reclosable zipper and comprising a flange;

a portion of at least one of the flanges being thickened to facilitate bonding said flanges to walls of the package without also heating sealing of the first and second members together in the area of the thickened flange; and disposing a strip of material different than the material comprising the reclosable zipper on the first closure member, alongside of and spaced from the first zipper portion, that is capable of being heat sealed to form a peel seal with the second closure member.

8. A method of claim 7 comprising the further step of disposing a further strip of peelable material on the second closure member at a location corresponding to the peelable strip of the first closure member, whereby the two strips of peelable material may be placed in opposed relation by aligning the first and second portions of the reclosable zipper.

9. The method of claim 7, comprising the further step of pressing together the first and second portions of the reclosable zipper to form a complete package closure.

10. A method of forming an article in the form of a strip, being separable into two parts and adapted for use as a package closure, comprising the steps of:

extruding a first part of the article comprising an elongate strip having a first portion of a zipper, a flange adapted for attachment to a wall of a package, and an opposable surface substantially parallel to and adjacent the zipper portion and adapted for forming a heat seal;

extruding the second part of the article comprising an elongate strip including a second portion of a zipper, a flange adapted for attachment to a wall of a package, and a surface adjacent the zipper portion disposed so as to be opposite the said opposable surface of the first part of the article upon alignment of the zipper portions;

a portion of at least one of said flanges being thickened to facilitate bonding said flanges to the walls of the package without also heat sealing the parts of the strip together in the area of the thickened flange; and providing at least one of said surfaces with a strip of peelable material different than the material comprising the zipper portions and capable of cooperating with the other part of the article to form a peel seal therebetween by heating said peelable material when said heat seal is made.

11. A method of producing a sealing system for a package comprising the steps of:

forming first and second profile strips, each strip comprising longitudinally-extending reclosable seal means and a flange adapted for bonding to a package wall, a portion of at least one of the flanges being thickened to facilitate bonding said flanges to the package wall without also heat sealing the strips together in the area of the thickened flange; and disposing on at least the first of the profile strips a length of peelable material capable of forming a peel seal with the second profile strip, the peelable material being disposed intermediate the flange and the reclosable seal means of the first strip.

12. The method of claim 1, comprising the step of disposing on the second of the profile strips a length of peelable material capable of forming a peel seal with the first profile strip, the peelable material of the second strip being disposed intermediate the flange and the reclosable seal means of the second strip.

13. The method of claim 11, said forming step comprising the step of forming first and second profile strips comprising reclosable means of the interlocking type.

14. A method of producing a sealing system for a package comprising the steps of:

forming first and second profile strips, each strip comprising longitudinally-extending reclosable seal means and a flange adapted for bonding to a package wall, a portion of at least one of the flanges being thickened to facilitate bonding said flanges to the package wall without also heat sealing the strips together in the area of the thickened flange; and disposing on at least the first of the profile strips a length of peelable material capable of forming a peel seal with the second profile strip, the reclosable seal means being disposed intermediate the flange and the peelable material of the first strip.

15. The method of claim 14, comprising the step of disposing on the second of the profile strips a length of peelable material capable of forming a peel seal with the first profile strip, the reclosable seal means of the second strip being disposed intermediate the flange and the peelable material of the second strip.

16. The method of claim 14, said forming step comprising the step of forming first and second profile strips comprising reclosable means of the interlocking type.

17. An article of manufacture comprising:

first and second elongate closure strips respectively having formed thereon first and second zipper elements and respective first and second flanges adapted for subsequent bonding to packaging material to form walls of a package, a portion of at least one of said first and second flanges being thickened to facilitate bonding said flanges to packaging material without also heat sealing the strips together in the area of the thickened flange; and an elongate strip of peelable material formed longitudinally along at least one of said first and second closure strips proximate the zipper element for forming a peel seal between the first and second elongate strips, wherein said peelable material is different than the material comprising the zipper element and forms said peel seal by heat sealing.

18. The article of claim 17, wherein the peelable material is selected from the group consisting of:

a) a blend of polybutylene and ethylene vinyl acetate copolymer and b) ionomer resin.

19. A package having walls secured to two mating profile strips, the package comprising:

first and second elongate closures each located on one of the profile strips, the closures respectively comprising reclosable elements for selectively separating and joining the first and second closures, the closures being bound together by an elongate peel seal formed to one side of the reclosable elements, the peel seal being formed between strips of peel seal material, heat sealed to form a peelable seal, formed longitudinally on the profile strips, wherein the peel seal material is different than the material comprising the reclosable elements, the profile strips further each comprising a flange adapted for bonding to the package walls, a portion of at least one of the flanges being thickened to facilitate bonding said flanges to the package walls without also heat sealing the strips together in the area of the thickened flange; and package walls extending along sides of the first and second closures and respectively affixed thereto.

20. The package of claim 19, wherein the peel seal is disposed between the reclosable elements and the interior of the package.

21. The closure of claim 19, wherein the reclosable elements are disposed between the peel seal and the interior of the package.

22. The closure of claim 19, wherein the reclosable elements comprise interlocking elements of the zipper type.

* * * * *

UNITED STATES PATENT AND TRADEMARK OFFICE

CERTIFICATE OF CORRECTION

PATENT NO. : 5,238,306

DATED : August 24, 1993

INVENTOR(S) : David A. Heintz et al.

It is certified that error appears in the above-identified patent and that said Letters Patent is hereby corrected as shown below:

On the Title Page

In column 2, line 14, under "U.S. PATENT DOCUMENTS", replace "4,325,653" with --4,235,653--.

In page 2, column 1, after line 12, under "U.S. PATENT DOCUMENTS", insert a new line:

--4,514,962 5/1985 Ausnit--.

In page 2, column 2, lines 10-11, replace "*Proceeding*" with --*Proceedings*--.

In column 3, line 68, insert --.-- (period) immediately after "material".

UNITED STATES PATENT AND TRADEMARK OFFICE

CERTIFICATE OF CORRECTION

PATENT NO. : 5,238,306

DATED : August 24, 1993

INVENTOR(S) : David A. Heintz et al.

It is certified that error appears in the above-identified patent and that said Letters Patent is hereby corrected as shown below:

In the Claims

In Claim 12, line 1, replace "1" with --11--.

In Claim 21, line 1, replace "closure" with --package--.

In Claim 22, line 1, replace "closure" with --package--.

Signed and Sealed this

Third Day of April, 2001

*Attest:*

NICHOLAS P. GODICI

*Attesting Officer*

*Acting Director of the United States Patent and Trademark Office*